US006203634B1

(12) United States Patent
Volkmuth

(10) Patent No.: US 6,203,634 B1
(45) Date of Patent: Mar. 20, 2001

(54) METHOD FOR HEAT-TREATING STEEL OR CAST IRON COMPONENTS

(75) Inventor: Johann Volkmuth, Niederlauer (DE)

(73) Assignee: SKF GmbH, Schweinfurt (DE)

( * ) Notice: Subject to any disclaimer, the term of this patent is extended or adjusted under 35 U.S.C. 154(b) by 0 days.

(21) Appl. No.: 09/429,563

(22) Filed: Oct. 28, 1999

(30) Foreign Application Priority Data

Oct. 28, 1998 (DE) ..... 198 49 681

(51) Int. Cl.[7] ..... C21D 6/00; C21D 1/18; C21D 9/40

(52) U.S. Cl. ..... 148/663; 148/660; 148/662; 148/612

(58) Field of Search ..... 48/612, 663, 662, 48/660

(56) References Cited

U.S. PATENT DOCUMENTS

Re. 28,645 * 12/1975 Aoki et al. ..... 148/12
4,203,783 * 5/1980 Economopoulos et al. ..... 148/12.4
4,204,892 * 5/1980 Economopoulos ..... 148/145
4,295,902 * 10/1981 Economopoulos ..... 148/144
4,992,111 * 2/1991 Yamada et al. ..... 148/12.4
5,292,384 * 3/1994 Klueh et al. ..... 148/333
5,334,269 * 8/1994 Khare et al. ..... 148/638
5,672,217 * 9/1997 Hengerer et al. ..... 148/589

FOREIGN PATENT DOCUMENTS 4007487 9/1991 (DE) .

* cited by examiner

*Primary Examiner*—Daniel J. Jenkins
*Assistant Examiner*—Nicole Coy
(74) *Attorney, Agent, or Firm*—Burns, Doane, Swecker & Mathis, L.L.P.

(57) ABSTRACT

A method for heat-treating a component of steel or cast iron, particularly a through hardening bearing steel component, involves heating the component to the austenitization temperature and holding the component at the austenitization temperature to achieve austenitization, rapidly quenching the component to approximately the martensite starting point ($M_S$ temperature) and holding the component at the bainite transformation temperature until partial bainite transformation occurs. After partial bainite transformation, the component is cooled down to and briefly held at room temperature, followed by short-cycle tempering.

21 Claims, 4 Drawing Sheets

METHOD FOR HEAT-TREATING STEEL OR CAST IRON COMPONENTS

This application is based on and claims priority under 35 U.S.C. §119 with respect to German Application No. P 19849681.8 filed on Oct. 28, 1998, the entire content of which is incorporated herein by reference.

FIELD OF THE INVENTION

The present invention generally relates to a method for heat-treating steel or cast iron components. More particularly, the present invention pertains to a method for heat-treating through hardened bearing steel components.

BACKGROUND OF THE INVENTION

Rolling bearing manufacturers decide upon the type of heat treatment to be used for rolling bearing components depending on the particular application for the rolling bearing, or the types and sizes of the roller bearings. For through hardened bearing steel components, two heat-treating methods are available—martensite hardening or austempering. Component properties such as hardness, microstructure, retained austenite content, and dimensional stability are associated with or affected by the particular type of heat treatment employed.

The following table provides an overview and comparison of various component properties associated with different heat treatment methods.

| Method | Hardness HRC | Retained Austenite % | Dimensional Stability Δ D/D |
|---|---|---|---|
| Martensite Hardening (tempered normally) | 62 . . . 55 | 8 . . . 16 | +60 μm/100 μm |
| Martensite Hardening (stabilized) | 58 . . . 62 | ≦3 | +15 μm/100 μm |
| Austempering | 58 . . . 63 | ≦3 | +15 μm/100 μm |

Austempering and martensite hardening (stabilized) do not differ significantly with respect to hardness, retained austenite and dimensional stability. Austempering, however, has better toughness properties than martensite hardening and also has a different residual stress state. Both methods also suffer from various disadvantages.

At present, both methods are always embodied completely. That is, either a martensite transformation or a bainite transformation takes place. In addition, time-temperature combinations, quenching and transformation in the bainite stage are done in the manner specified in time-temperature transformation diagrams such as FIG. 1 from the *Atlas zur Wärmebehandlung der Stähle,* the Atlas of Heat-Treatment of Steels.

The time required to attain the desired component properties is relatively long. For through hardened bearing steel components, the time required can be more than four hours, both for austempering and in martensitically hardened stabilized components.

The previously known methods described above preclude one another and so it is not possible to combine the properties of austempering and martensite hardening. Nor is it possible with current methods to reduce the total process time.

A need thus exists for a method of heat-treating a steel or cast iron component, including a through hardened bearing steel component, in a shorter time yet with the component possessing the desired properties.

SUMMARY OF THE INVENTION

The present invention provides a method for heat-treating steel components, especially through hardened bearing steel components, to establish arbitrary intermediate states of the microstructure between martensite and bainite, and to adapt the product properties of the components to suit the demands or requirements of a particular application, while at the same time reducing the treatment time. The method involves implementing various process parameters relating to austenitization of the component, the quenching of the component from the austenitizing temperature, the temperature at the onset of bainite transformation and the time period for which the component is held in the bainite state, the cooling down of the component after partial bainite transformation, and the time until the tempering treatment.

According to one aspect of the invention, a method for heat-treating a component of steel or cast iron, particularly a through hardened bearing steel component, involves heating the component to the austenitization temperature and holding the component at the austenitization temperature to achieve austenitization, rapidly quenching the component to approximately the martensite start point or $M_S$ temperature, and holding the component at the bainite transformation temperature until partial bainite transformation prior to complete transformation occurs. After partial bainite transformation, the component is cooled down to and briefly held at room temperature, followed by short-cycle tempering.

In accordance with another aspect of the invention, a method for heat-treating a steel or cast-iron component includes heating the component to the austenitization temperature and holding the component generally at such temperature, quenching the component and holding the component at a temperature to effect partial bainite transformation, rapidly cooling the component to room temperature after partial bainite transformation in the component has occurred, holding the component at room temperature, and short-cycle tempering the component.

BRIEF DESCRIPTION OF THE DRAWING FIGURES

The foregoing and additional features of the present invention will become more apparent from the following detailed description considered with reference to the accompanying drawing figures in which.

DETAILED DESCRIPTION OF THE INVENTION

The method according to the present invention involves heat-treating steel components, particularly through hardened bearing steel components. The method is designed to establish intermediate states of the microstructure between martensite and bainite, thus allowing the properties of the components to be tailored to the requirements of a particular application. In addition, the method allows the time associated with the heat-treatment to be reduced.

Generally speaking, the method involves heating the component to austenitization, quenching the component, effecting bainite transformation in the component and generally holding such temperature, cooling down the component and holding such temperature, and then short-cycle tempering the component. The method also comprises varying and setting various process parameters associated with the method, including the austenitization of the component, the cooling rate of the component from the austenitizing temperature, the temperature when the onset of bainite transformation occurs, the holding time of the component in the range of the bainite state, the manner of cooling down the component after such treatment (i.e., the speed and final temperature), the holding time until the tempering treatment, and the short-cycle tempering.

The parameters are set in accordance with the present invention taking into account the following considerations.

Austenitization

Figure 1A:
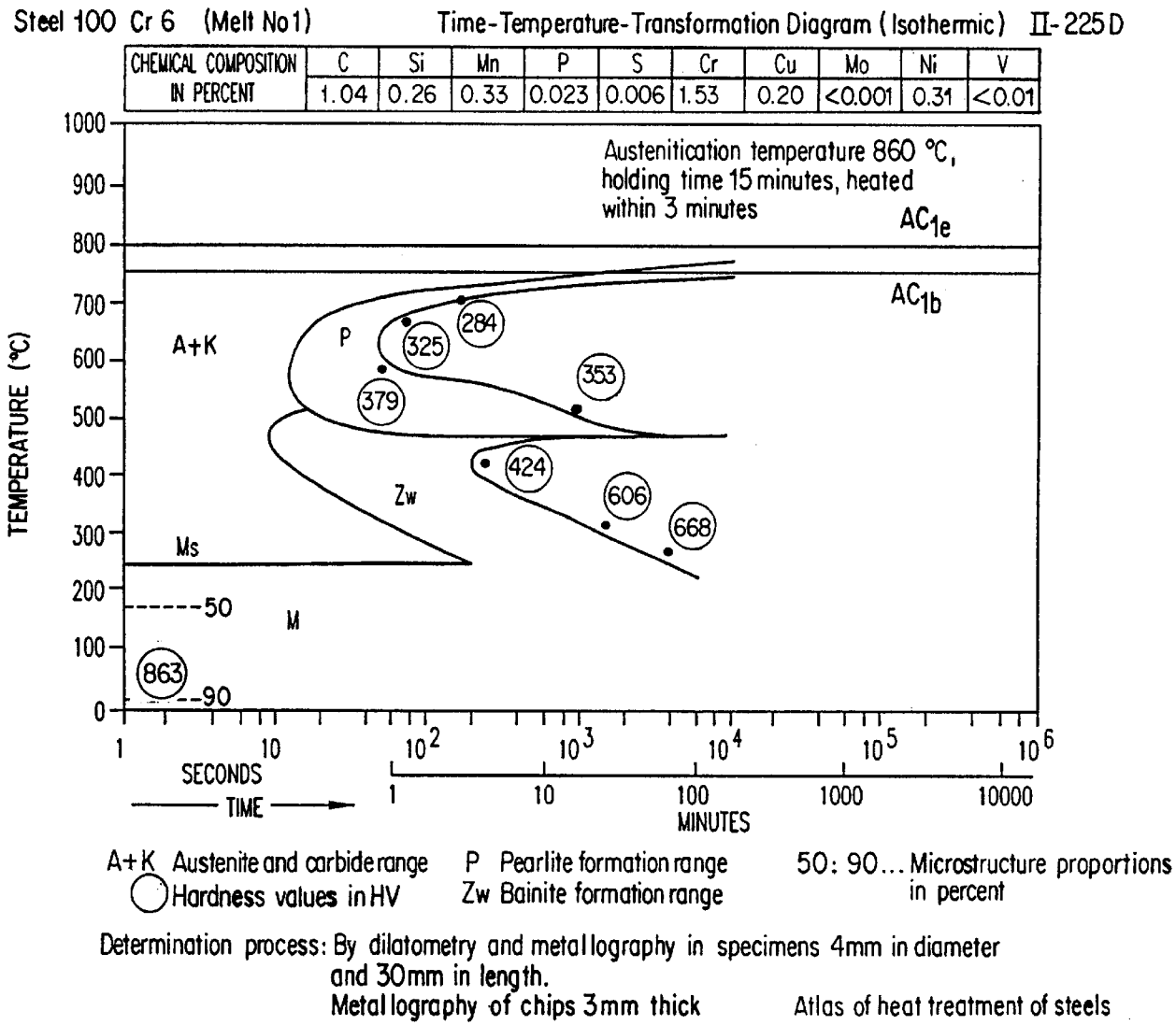
FIG. 1 is a time and temperature austenitization diagram.
Figure 1B:
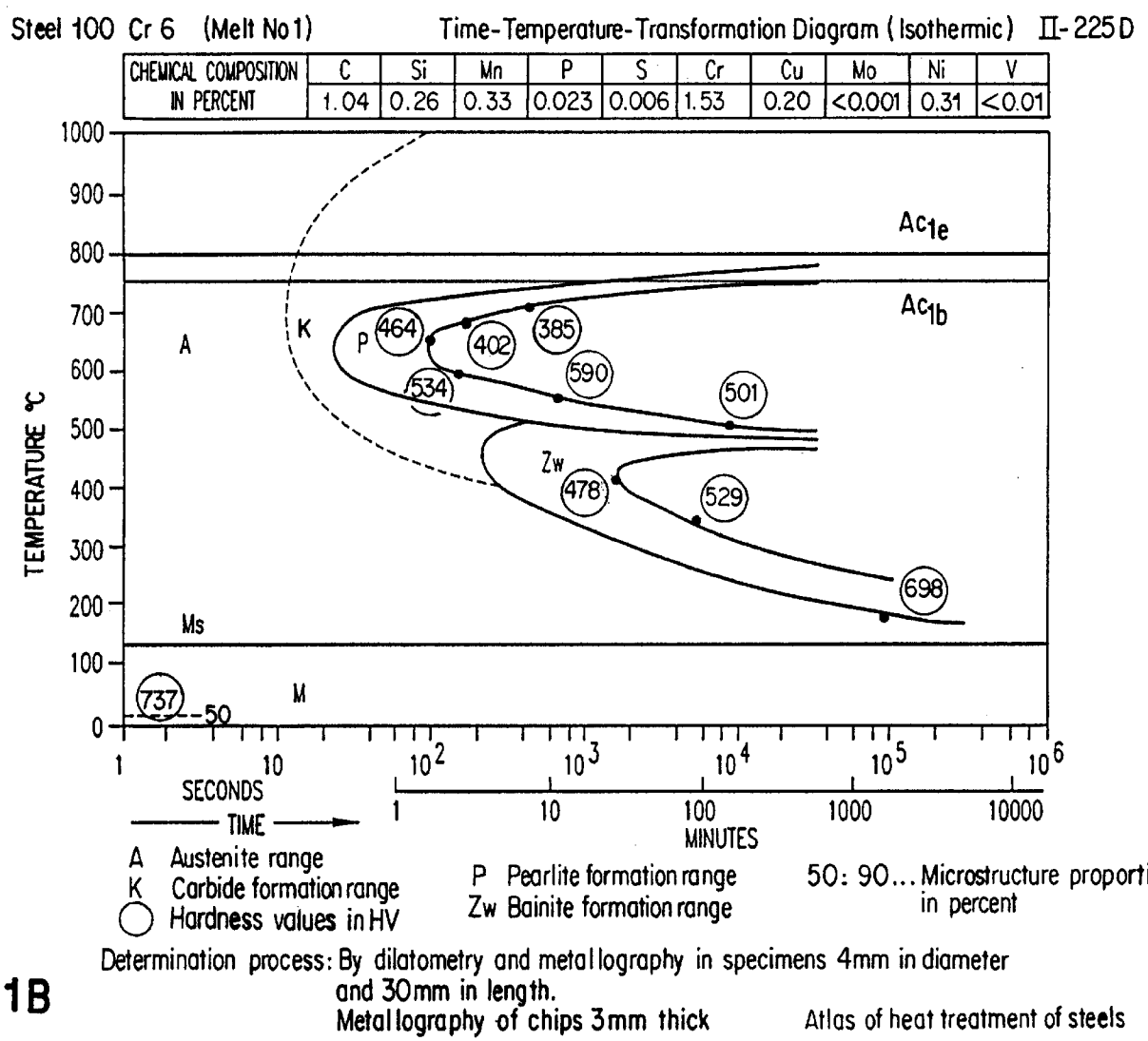

The matrix carbon content can be set via suitable time and temperature combinations as illustrated in the time and temperature austenitization diagrams in FIG. 1. This matrix carbon content also dictates the martensite starting point, the length of time until the bainite transformation begins, and the duration of the bainite transformation.

Cooling Rate

The cooling rate should preferably be selected such that troostite formation (precipitation of fine lamella pearlite out of the transformation microstructure) is suppressed. The quenching can, in accordance with further aspect of the present invention, be performed in a known manner using salt baths or oils as the quenching medium. However, water-air mixtures (sprays) or gases can also be used. In accordance with the present invention, the cooling of the component is stopped before the martensite starting point ($M_S$ temperature) is undershot. That is, cooling is stopped before the temperature of the component falls below the martensite start point. For through hardened bearing steel 100 Cr6 (SAE 51000) (and the condition of suitable austenitization), this means that the cooling of the component is stopped before approximately 235° C. as can be seen from FIG. 1. However, it should be recognized that briefly lowering the component temperature to values below the $M_S$ temperature can prove to be advantageous. In such a case, martensite would already have formed in the peripheral layer before the further transformation takes place for the remainder of the component cross section.

Temperature at the Onset of Bainite Transformation

The temperature at the onset of bainite transformation determines the type of bainite that forms (lower or upper bainite stage) and thus also the properties of this portion of the microstructure. The higher this temperature, the lower the resultant hardness, yet also the higher the toughness (at least in the lower bainite state). The temperature should preferably vary within the range just above the $M_S$ temperature, that is approximately 225° C. to approximately 270° C. Otherwise, because of the low hardness that is attained, a shortened bearing life or service life may result.

Holding Time at the Bainite Transformation Temperature

The longer the holding time at the bainite transformation temperature, the greater the proportional quantity of the bainite microstructure. The quantity of bainite that forms is not proportional to the holding time in the transformation range. Even after approximately 20 percent of the time needed for the complete transformation, approximately 50 percent of the microstructure has transformed to bainite. A variation in the holding time leads to a variation in the proportions of bainite, martensite and retained austenite in the microstructure, thus possibly leading to altered product properties.

Cooling Down after Partial Bainite Transformation

The cooling down that is performed after the partial bainite transformation should proceed as fast as possible. In accordance with the present invention, the cooling down is preferably performed in an expedient manner using water-air mixtures. Cooling in still air does not appear to be well suited to achieving the objectives associate with the present invention because the total process time is lengthened, at least until the $M_S$ temperature is reached other bainite portions form, and possible stresses can arise that might lead to microcracks.

The final temperature of the component is typically room temperature. According to a further aspect of the invention, however, postquenching can also be provided in between the time when room temperature is reached and the temperature is held before tempering. This postquenching can be carried out at between about 0° C. and 10° C. With this postquenching, the dimensional stability of the components is improved which can be advantageous in particular applications.

Holding Before Tempering

The holding time until the tempering is started should be as short as possible. This hold time should preferably be on the order of five minutes at most. It is possible, for example in short-cycle hardening systems, that this hold time can be on the order of approximately three minutes.

Short-Cycle Tempering

The tempering of the martensite formed upon cooling down from the martensite starting temperature, and optionally of the already previously existing bainite, is performed using a short-cycle tempering process such as that described in German Patent DE 40 07 487 C2, the entire content of which is incorporated herein by reference. Both the system temperature and the total cycle time can be selected such that the requisite hardness values, retained austenite contents, dimensional stability requirements, and the like can be met.

Depending on the selection of the aforementioned process parameters, when the method of the present invention is employed, a microstructure will be present in which various proportions of bainite, martensite and possibly retained austenite exist side by side. These proportions can also vary over the cross section of the component.

It is believed to be necessary to relatively strictly adhere to the predetermined process parameters, such as holding times, temperatures, and quenchant properties. For this reason, it is important to use systems that meet the requirements in terms of process controllability and temperature uniformity. That is, the equipment constituting the complete heat treatment facility (e.g., austenizing furnace, quenching stations, washing stations, tempering furnace and the like) must be capable of accurately controlling the various stages of the method of the present invention.

These system requirements are also prerequisites for being able to set existing product requirements in a targeted way and also achieve such requirements. In this way, the previously conventional tolerances, such as for hardness, can be narrowed to a much greater degree. For example, instead of the conventional hardness of 58 . . . 62 HRC for martensite hardening (stabilized) or bainite hardening, it is possible for instance to specify and achieve a hardness of 58 . . . 60 HRC, 59 . . . 61 HRC, or optionally even 62 . . . 63 HRC. For targeted setting of the process parameters, it is recommended that suitable PC programs be used to calculate the expected product properties from, among other aspects, the chemical composition of the heat used and the austenitization, quenching and transformation conditions. A kind of self-optimization of the method is thus possible with the present invention.

Figure 2:
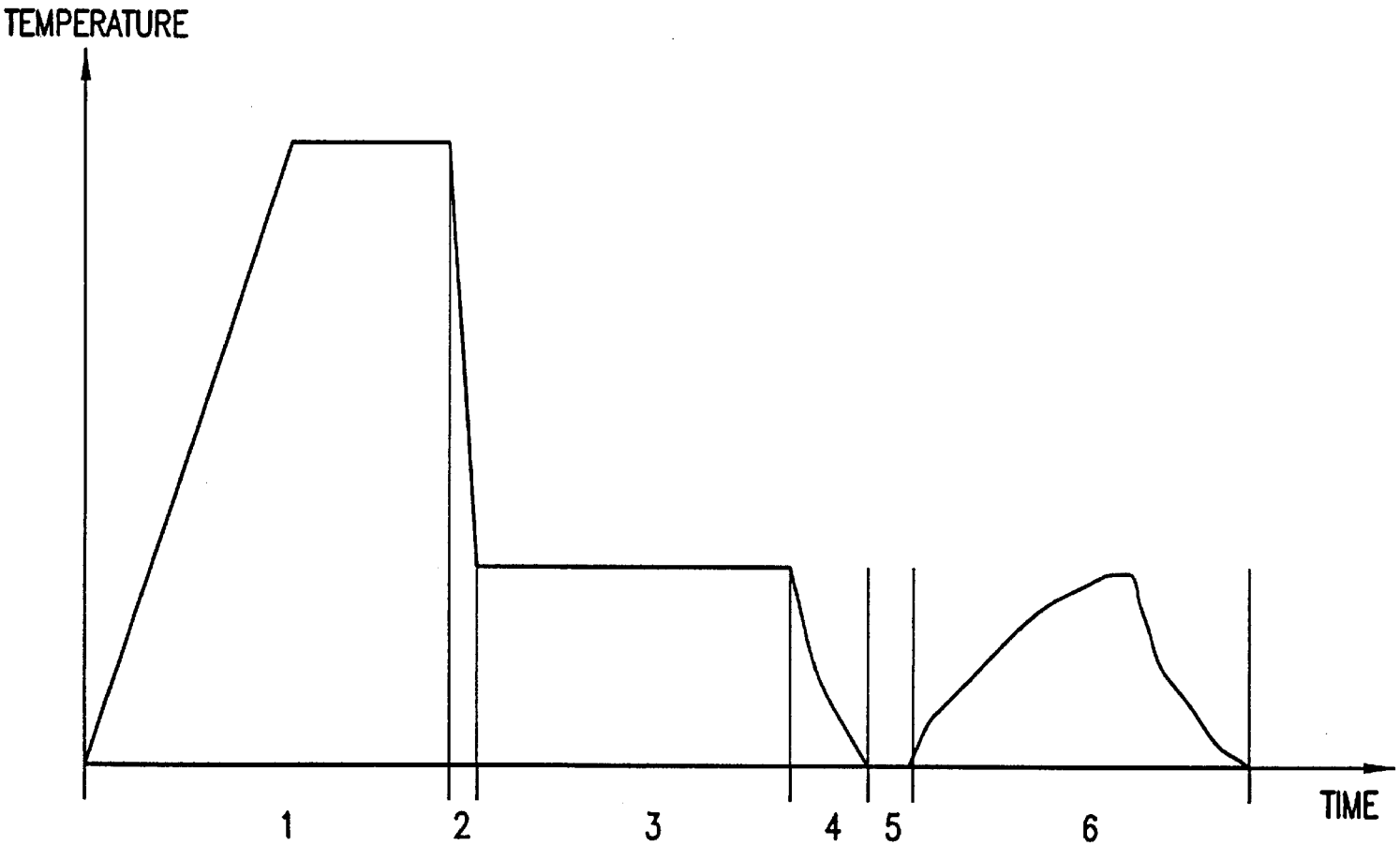
FIG. 2 is a flow chart or timing chart illustrating the sequence of steps performed in connection with the method of the present invention.

A flow chart illustrating a preferred method according to the present invention is shown in FIG. 2. The method involves first heating the component, for example a rolling bearing component, to the austenitization temperature (approximately 860° C. to 1050° C.) and holding the component at that temperature for approximately 0.01 to approximately 0.5 hours, depending on the wall thickness. This portion of the method is identified as stage 1 in FIG. 2. From this austenitization temperature, the component is quenched in the briefest possible time in a salt bath to a temperature of approximately 225° C. to approximately 270° C., just above the $M_S$ temperature, with the cooling rate being selected such that troostite formation is suppressed. This is stage 2 of the time-temperature transformation diagram shown in FIG. 2. In stage 3, the component is held at this temperature of approximately 225° C. to approximately 270° C. until the desired proportional quantity of the bainite microstructure relative to martensite and retained austenite is reached. In the example shown, the holding time is approximately 1 hour.

After that, in stage 4, a rapid cooling of the component to generally room temperature takes place, for instance using a water and air mixture. In stage 5, the component is briefly held at the temperature reached in stage 4 for a maximum duration of five minutes, preferably less than or equal to three minutes. Then, in stage 6, short-cycle tempering takes place. This short-cycle tempering can be done in accordance with German Patent DE 40 07 487, in which the components are tempered within a heat-up time which is limited by the formula: t/d=50 to 210 (where t=heat-up temperature in seconds and d=wall thickness of the component in mm), and at a temperature that is up to 100 kelvins above the tempering temperature of 200° C. to 260° C. The temperature employed here is selected such that at the predetermined heat-up time, a hardness in the component of 55 to 65 HRC results. The component is then cooled down immediately to room temperature as shown at the end of stage 6 in FIG. 2.

Figure 3:
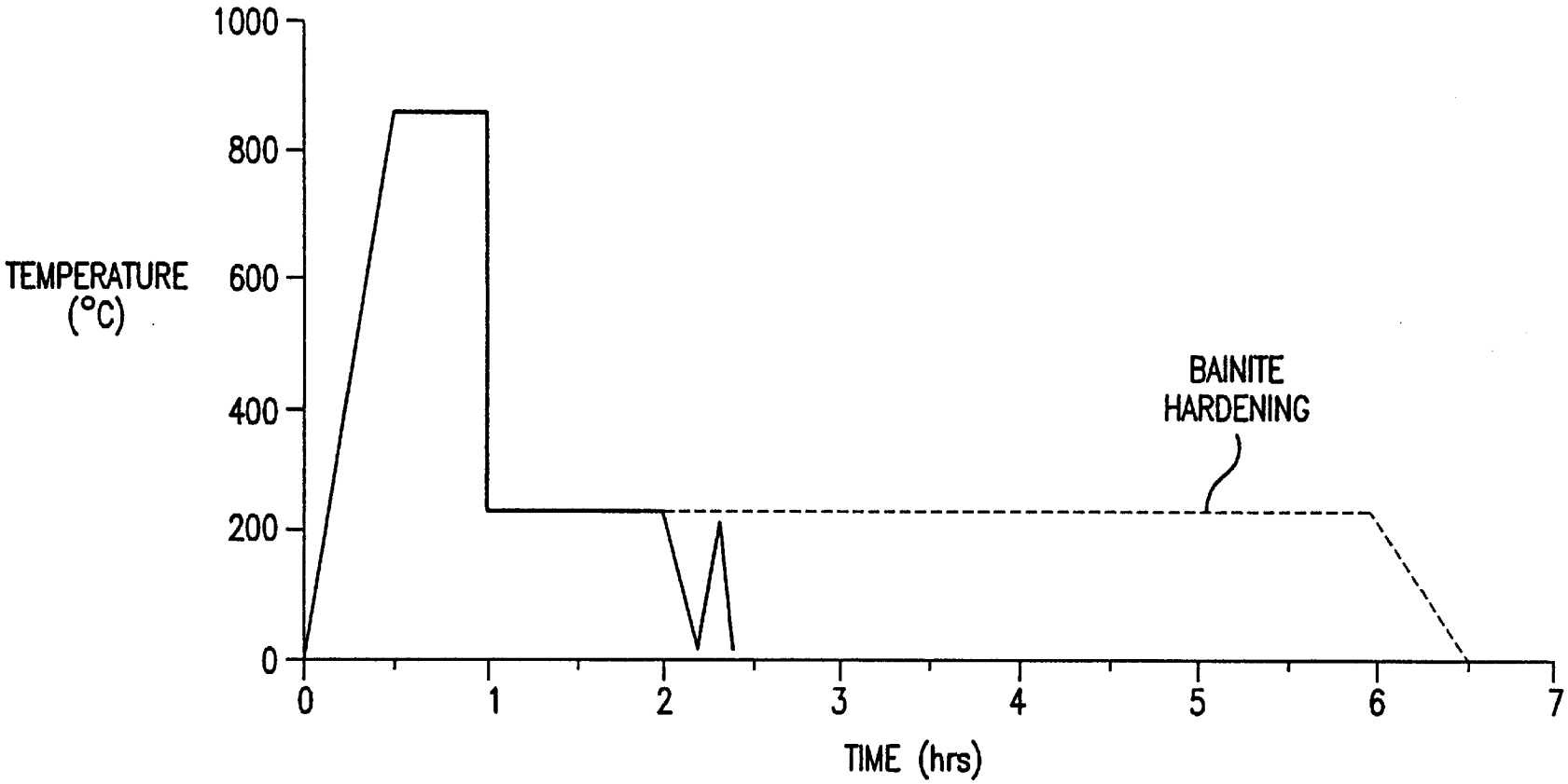
FIG. 3 is a flow chart or timing chart illustrating the sequence of steps performed in connection with the method of the present invention.

As already noted, postquenching can be carried out between the cooling down after the partial transformation and the holding before the short-cycle tempering. This method according to the present invention is, as shown in FIG. 3, substantially faster than the usual bainite hardening represented by the dotted line.

In light of the foregoing, it can be seen that the present invention provides a method for heat-treating steel or cast-iron components, especially through hardened bearing steel components, that allows intermediate states of the microstructure between martensite and bainite to be established in the component. The method allows the product properties of the components to be suited to the demands or requirements of a particular application. Further, the method advantageously allows the treatment time to be reduced.

The method of the present invention is described in the context of through hardened rolling bearing components. These components include rings, rollers, balls, washers and generally all parts of a rolling bearing made of through hardened bearing steel. Other through hardened steel grades could be hardened utilizing the present invention, depending upon their chemical composition, the wall thickness of the component, and the like. With these other through hardened steel grades, a change in process parameters, primarily the times and temperatures, might be necessary. Nevertheless, the sequence of steps associated with the present invention would remain the same or substantially the same.

The principles and preferred embodiment of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A method for heat-treating a through hardened bearing steel component comprising:

heating the bearing steel component to austenitization temperature;

maintaining the bearing steel component at said austenitization temperature;

rapidly quenching the bearing steel component to approximately a martensite starting point temperature;

maintaining the bearing steel component at a temperature for effecting partial bainite transformation;

rapidly cooling the bearing steel component to room temperature after partial bainite transformation;

briefly holding the bearing steel component at room temperature; and short-cycle tempering the bearing steel component.

2. The method of claim 1, wherein the rapid quenching is performed so that troostite formation is suppressed.

3. The method of claim 2, wherein the rapid quenching of the bearing steel component is stopped before the martensite starting point is undershot.

4. The method of claim 2, wherein the rapid quenching is performed in a salt bath.

5. The method of claim 2, wherein the rapid quenching is performed in oil.

6. The method of claim 2, wherein the rapid quenching is performed in a water-air mixture.

7. The method of claim 2, wherein the rapid cooling of the bearing steel component to room temperature is performed in a water-air mixture.

8. The method of claim 2, wherein the rapid quenching is performed in gas.

9. The method of claim 1, wherein the rapid quenching of the bearing steel component is stopped before the martensite starting point is undershot.

10. The method of claim 1, wherein the step of maintaining the bearing steel component at a temperature to effect partial bainite transformation involves maintaining the bearing steel component at a temperature just below the martensite starting point.

11. The method of claim 1, wherein the rapid cooling of the bearing steel component to room temperature is performed in a water-air mixture.

12. The method of claim 1, including postquenching the bearing steel component between the rapid cooling of the bearing steel component to room temperature and the brief holding of the bearing steel component at the room temperature.

13. The method of claim 1, wherein the bearing steel component is held at room temperature for a duration limited to a maximum of five minutes.

14. The method of claim 1, wherein the bearing steel component is held at room temperature for a duration less than or equal to three minutes.

15. A method for heat-treating a steel or cast-iron component comprising:

heating the component to austenitization temperature and holding the component at said austenitization temperature;

quenching the component and holding the component at a temperature to effect partial bainite transformation;

rapidly cooling the component to room temperature after partial bainite transformation in the component has occurred;

holding the component at room temperature; and short-cycle tempering the component.

16. The method of claim 15, wherein the quenching of the component is performed so that troostite formation is suppressed.

17. The method of claim 16, wherein the quenching of the component is stopped before the martensite starting point is undershot.

18. The method of claim 15, wherein the quenching of the component is stopped before the martensite starting point is undershot.

19. The method of claim 15, wherein the component is quenched and held at a temperature just below the martensite starting point.

20. The method of claim 15, wherein the component is held at room temperature for a duration limited to a maximum of five minutes.

21. The method of claim 15, wherein the component is held at room temperature for a duration less than or equal to three minutes.

* * * * *